US005107985A

United States Patent [19]

Bezrutczyk et al.

[11] Patent Number: 5,107,985

[45] Date of Patent: Apr. 28, 1992

[54] DISPLAY CARTON WITH HINGED DRAWER AND BLANK FOR MAKING THE SAME

[75] Inventors: Arthur M. Bezrutczyk, Scotch Plains; Robert J. Blackburn, Jr., Chatham, both of N.J.

[73] Assignee: Shell Containers, Inc., New York, N.Y.

[21] Appl. No.: 561,058

[22] Filed: Aug. 1, 1990

[51] Int. Cl.[5] ..... B65D 5/38

[52] U.S. Cl. ..... 206/45.15; 229/110; 229/115

[58] Field of Search ..... 206/44.11, 44.12, 45, 206/45.11, 45.12, 45.14, 45.15, 45.17, 45.18, 45.19; 229/109, 110, 115

[56] References Cited

U.S. PATENT DOCUMENTS

| | | | |
|---|---|---|---|
| 1,817,766 | 8/1931 | Rhodes, Jr. | 206/45.15 |
| 2,284,527 | 5/1942 | Lonz | 206/45.15 |
| 3,891,136 | 6/1975 | Woeste | 229/115 |
| 4,094,404 | 6/1978 | Miller et al. | 206/45.15 |
| 4,121,752 | 10/1978 | Ravotto et al. | 229/115 |

*Primary Examiner*—Jimmy G. Foster
*Attorney, Agent, or Firm*—Steinberg & Raskin

[57] ABSTRACT

A display carton for holding and displaying an article formable from a unitary blank includes a tubular container structure and a tubular drawer structure by which an article is displayed by opening and closing the drawer structure. With the drawer structure in its closed position, the carton comprises a polyhedron and preferably, a prism having a pair of opposed parallel faces or bases which may be triangular, hexagonal, etc. and a corresponding plurality of lateral faces in the shape of parallelograms. A blank for forming a display carton is also disclosed.

38 Claims, 7 Drawing Sheets

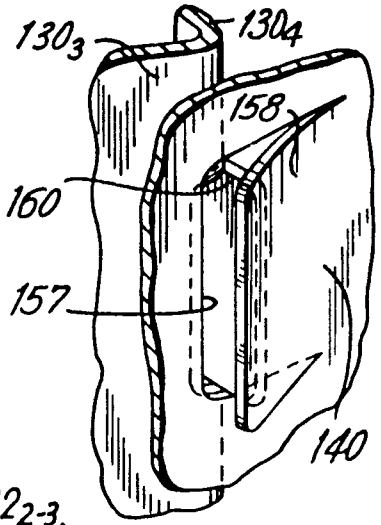
FIG. 14
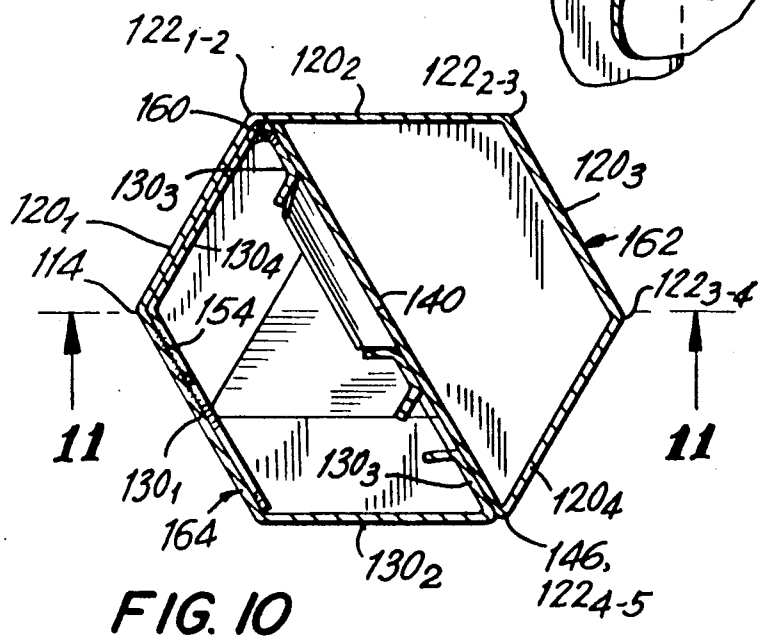
FIG. 10
FIG. 9
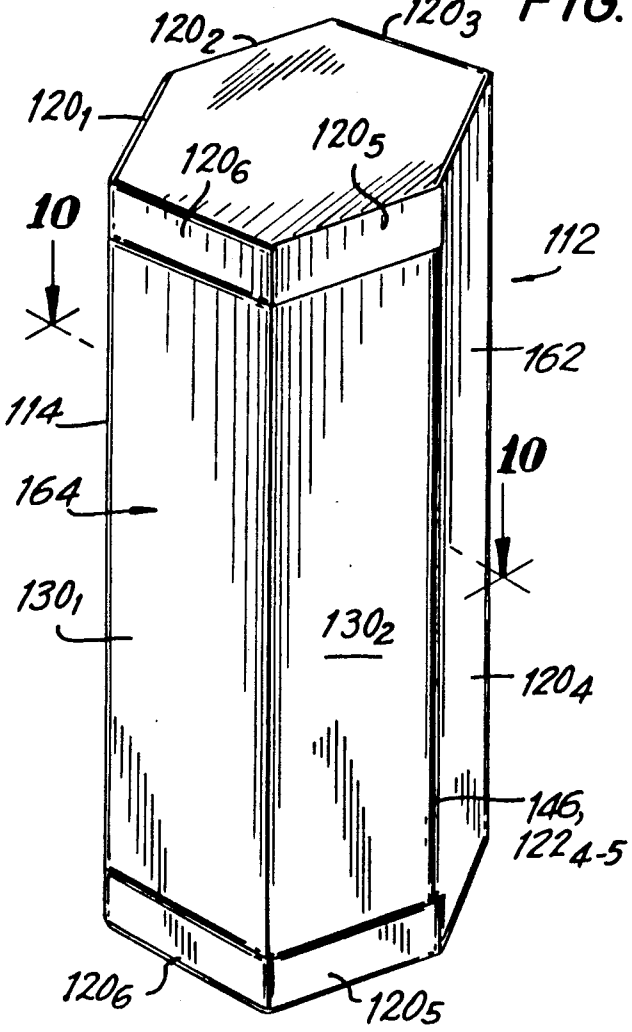

134
124
120₃
120₂
130₃
130₄
148
122₁-2
122₂-3
122₃-4
122₄-5
120₁
120₂
120₃
120₄
120₅
130₁
130₂
130₃
130₄
114
124
140
146,
148
149
154
158
160
162
164
166
168

DISPLAY CARTON WITH HINGED DRAWER AND BLANK FOR MAKING THE SAME

BACKGROUND OF THE INVENTION

This invention relates generally to carton structures and, more particularly, to cartons formed of foldable sheet material for displaying articles, and blanks for making such display cartons.

Cartons specially designed for displaying articles are well known. Generally, it is desired that such display cartons be economical in manufacture and simple in assembly and set-up while, at the same time being aesthetically pleasing and designed to facilitate the presentation of the article or articles contained in them. The display carton should therefore be space efficient, i.e., the amount of unused space and, therefore, the amount of surplus material, should be kept at to a relative minimum. It is also desirable that the carton be formable from a single blank of foldable sheet material for simplifying assembly.

SUMMARY OF THE INVENTION

Accordingly, it is a main object of the present invention to provide new and improved cartons for displaying articles, and blanks for making such display cartons.

Another object of the present invention is to provide new and improved display cartons which are economical in manufacture and simple in assembly and set-up.

Still another object of the present invention is to provide new and improved display cartons which are formable from a single, unitary blank of foldable sheet material.

Yet another object of the present invention is to provide new and improved display cartons which are aesthetically pleasing.

Still yet another object of the present invention is to provide new and improved display cartons having a design which facilitates the presentation of articles contained therein.

A further object of the present invention is to provide new and improved blanks of foldable sheet material for forming display cartons satisfying one or more of the above objects.

Briefly, in accordance with the present invention, these and other objects are attained by providing a display carton for holding and displaying an article including a tubular container structure and a tubular drawer structure by which an article is displayed by opening and closing the drawer structure from within and into the interior of the container structure. In particular, the drawer structure holds the article to be displayed and is movable between a first closed position situated within the interior of the container structure so that the article is not visible, and a second open position situated at least in part outside of the container structure and in which the article is visible for display. The carton is monolithic and may be formed from a unitary blank of foldable sheet material. With the drawer structure in its closed position, the shape of the carton comprises a polyhedron and, preferably, a prism having a pair of opposed parallel faces or bases, which may be triangular, hexagonal, etc., and a corresponding plurality of lateral faces in the shape of parallelograms. One or more faces of the prism are defined by panels of the container structure in association with panels of the drawer structure.

In accordance with another aspect of the invention, a blank is provided for forming a display carton of the type described above comprising a sheet of foldable material having a hinge line that divides the sheet into a container section and a drawer section. The container section of the blank comprises at least three container panels foldably interconnected with each other by fold lines which are parallel to the hinge line, and the drawer section of the blank similarly comprises at least three drawer panels foldably interconnected with each other by parallel fold lines. The hinge line is situated between adjacent ones of the container and drawer panels.

DESCRIPTION OF THE DRAWINGS

A more complete appreciation of the present invention and many of the attendant advantages thereof will be readily understood by reference to the following detailed description when considered in connection with the accompanying drawings in which:

FIG. 1(*b*) is a perspective view of the blank of FIG. 1(*a*), with the end closure flaps omitted for clarity, in an intermediate stage of construction of the display carton.

FIG. 9 is a perspective view of a display carton constructed from the blank of FIG. 8 in accordance with a second embodiment of the display carton the invention;

FIG. 10 is a section view of the display carton taken along line 10—10 of FIG. 9;

FIG. 14 is a fragmentary perspective view illustrating a part of the spring flap and cooperating detent means for locking the drawer structure in the open position.

DETAILED DESCRIPTION OF THE PREFERRED EMBODIMENTS

Figure 1A:
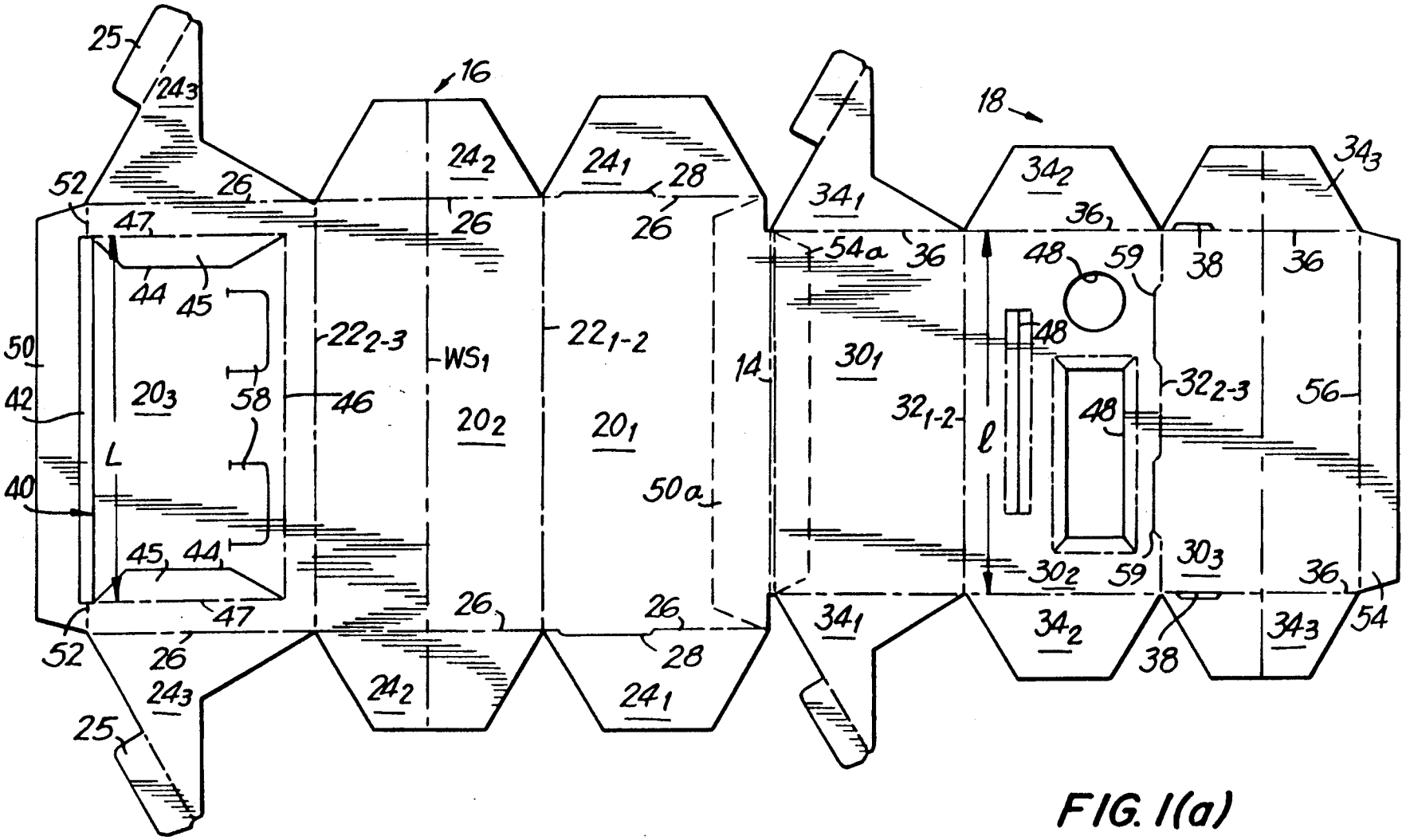
FIG. 1(*a*) is a plan view of a blank of foldable sheet material for forming a display carton in accordance with a first embodiment of the invention.
Figure 1B:
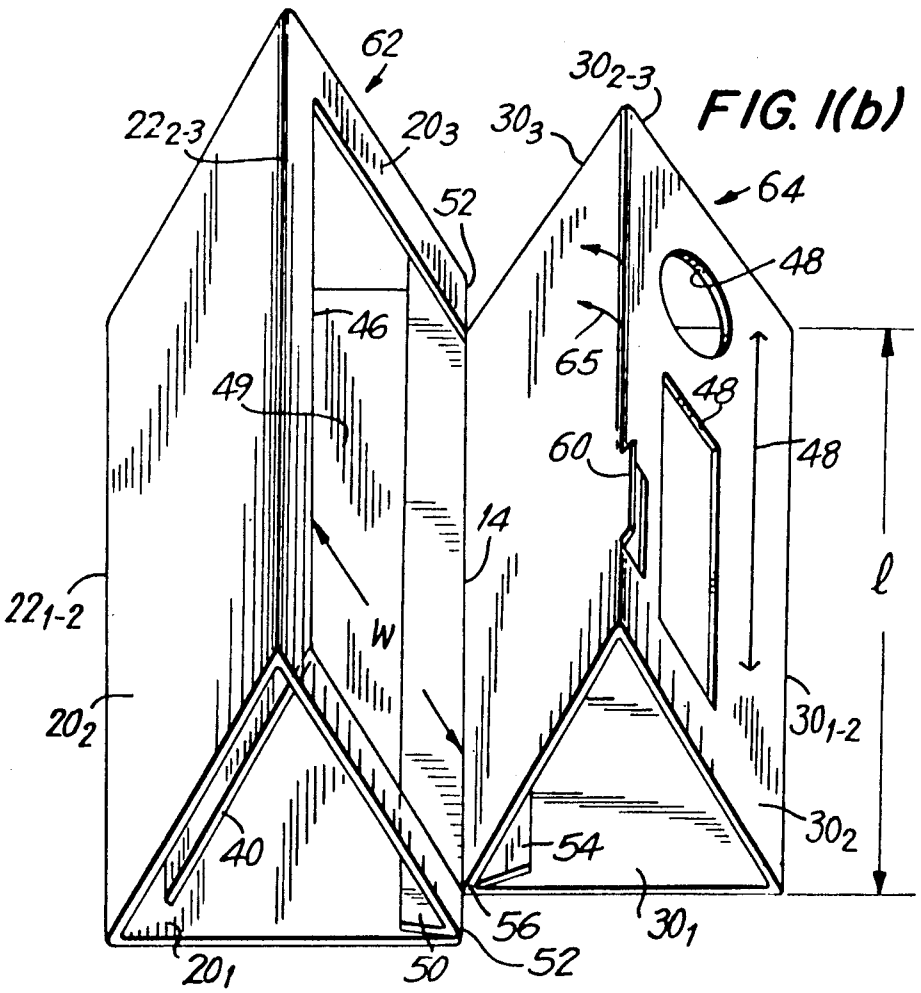

Referring now to the drawings wherein like reference characters designate identical or corresponding parts throughout the several views, and more particularly to FIG. 1, a blank 10 of foldable sheet material, such as paperboard, for forming a display carton 12 (FIG. 2) in accordance with the invention is illustrated. The blank 10 is crease scored to form a hinge line 14 in the mid-region of the blank which divides the blank into a container section 16 to the left of the hinge line 14 in the drawing, and a drawer section 18 to the right of the hinge line 14.

The container section 16 is crease scored to define three substantially rectangular container panels $20_1$, $20_2$, $20_3$ of substantially equal size. The first container panel $20_1$ is bordered on one side by hinge line 14 and is foldably interconnected to the intermediate container panel $20_2$ along a crease score defining a primary fold line, designated $22_{1-2}$. Similarly, the last container panel $20_3$ is foldably interconnected to the intermediate container panel $20_2$ by a crease score defining a primary fold line $22_{2-3}$Primary fold lines $22_{1-2}$ and $22_{2-3}$ are substantially parallel to hinge line 14 and to each other. Container end closure flaps $24_1$, $24_2$, $24_3$ are foldably joined to respective container panels $20_1$, $20_2$, $20_3$ by crease scores defining fold lines 26. A through-slit 28 is formed along each of the fold lines 26 between the first container panel $20_1$ and end closure flaps $24_1$.

In a similar fashion, the drawer section 18 is crease scored to define three substantially rectangular drawer panels $30_1$, $30_2$ and $30_3$ of substantially equal size. The first drawer panel $30_1$ is bordered on one side by hinge line 14 and is foldably interconnected to the intermediate drawer panel $30_2$ along a crease score defining a secondary fold line, designated $32_{1-2}$. The last drawer panel $30_3$ is foldably interconnected to the intermediate drawer panel $30_2$ by a crease score defining a secondary fold line $32_{2-3}$. Secondary fold lines $32_{1-2}$, $32_{2-3}$ are also substantially parallel to each other, to hinge line 14, and to primary fold lines 22. Drawer end closure flaps $34_1$, $34_2$, $34_3$ are foldably joined to respective drawer panels $30_1$, $30_2$, $30_3$ by crease scores defining fold lines 36. A through-slit 38 is formed along each of the fold lines 36 between last drawer panel $30_3$ and end closure flaps 34.

A container glue flap 50 is joined to the last container panel $20_3$ at its free end by a crease score defining fold line 52. Similarly, a drawer glue flap 54 is joined to the free end of the last drawer panel $30_3$ by a crease score defining a fold line 56. Each of the glue flaps has adhesive applied on its undersurface, i.e. the surface facing downwardly in the drawing.

A substantially rectangular inner flap 40 is formed in the last container panel $20_3$ by a narrow cutout 42 that extends along a major part of the panel on glue flap fold line 52, and a pair of opposed, shaped side-cuts 44. A crease score defining a hinge line 46 for flap 40 parallel to fold lines 22 and proximate to fold line $22_{2-3}$ extends between the ends of the cuts 44, and a pair of crease scores defining fold lines 47 interconnect the ends of the respective side cuts 44. It will be seen from the description below that when the flap 40 is bent out of the plane of the container panel $20_3$ around hinge line 46, and the tabs 45 formed between the side-cuts 44 and fold lines 47 are folded on fold lines 47, a substantially rectangular opening 49 (FIG. (1*b*)) is formed through which the drawer structure formed from the drawer section 18 of blank 10 can be moved into the interior of the container structure formed from the container section 16 of blank 10. In order to permit movement of the drawer structure through the opening 49, the distance L between fold lines 47 or, in other words, the lengths of cutout 42 and hinge line 46, is substantially equal to or slightly greater than the length l of the rectangular drawer panels $30_1$-$30_3$.

Variously shaped cutouts and/or slits 48 of appropriate configuration are formed in the intermediate drawer panel $30_2$ for accommodating the article or articles to be displayed when the drawer structure is in its open position.

Figure 2:
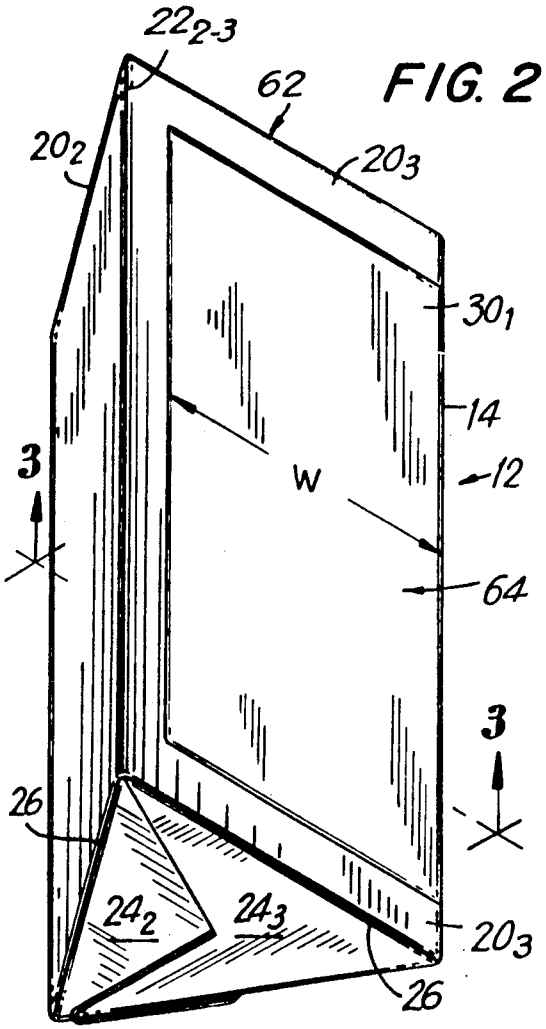
FIG. 2 is a perspective view of a display carton constructed from the blank of FIG. 1 in accordance with a first embodiment of the display carton of the invention.

The construction of display carton 12 from blank 10 will now be described. Referring to FIG. 1(*b*) in conjunction with FIG. 1(*a*), container structure 62 is formed by initially folding the container section 16 of blank 10 on a working score $WS_1$, and fold line 52 (which functions as a working score) and adhesively securing the glue flap 50 to the edge region of first container panel $20_1$. The use of the working score $WS_1$, facilitates the alignment of the fold line 52 with the hinge line 14. The container structure is then folded on primary fold lines $22_{1-2}$ and $22_{2-3}$ to form a prism-shaped tubular structure having a triangular cross section. The secured position of glue flap 50 on container panel $20_1$ is shown in phantom and designated 50*a* in FIG. 1(*a*). As seen in FIG. 2, the end closure flaps 24 are then folded inwardly on fold lines 26. Each end closure flap $24_3$ has a tab 25 (FIG. 1(*a*)) which is folded inwardly and inserted into a slit 28. The flap 40 is then bent inwardly on hinge line 46 and positioned within the interior of container structure 62 to thereby form opening 49 in container structure 62.

The drawer structure 64 of the display carton 12 is formed in a similar fashion by initially folding the drawer section 18 of blank 10 on a working score $WS_2$ and fold line 56 and adhesively securing the glue flap 54 to the edge region of first drawer panel $30_1$. The drawer structure is then folded on secondary fold lines $32_{1-2}$ and $32_{2-3}$ to form a prism-shaped tubular structure having a triangular cross section. The secured position of glue flap 54 on the drawer panel $30_1$ is shown in phantom and designated 54*a* in FIG. 1(*a*). The end closure flaps of the drawer are folded to close the ends of the drawer structure.

Figure 3:
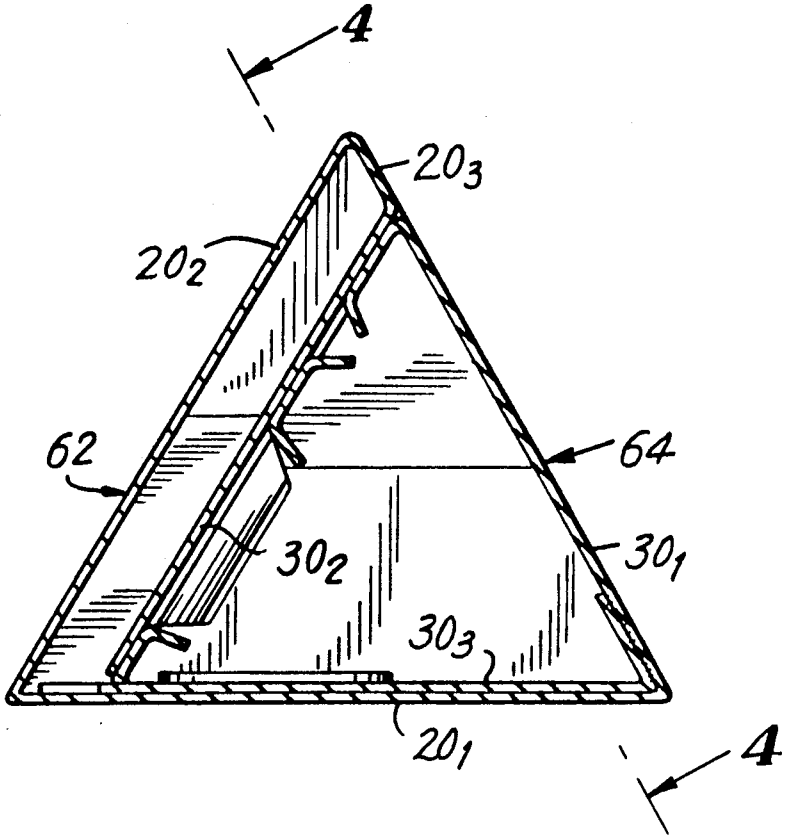
FIG. 3 is a section view of the display carton taken along line 3—3 of FIG. 2.
Figure 4:
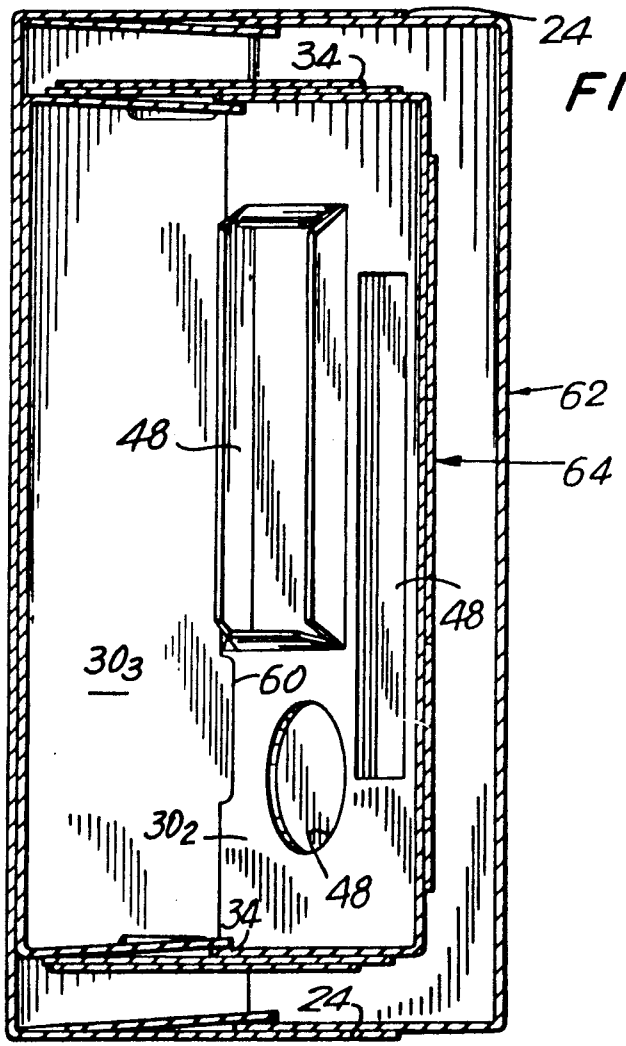
FIG. 4 is a section view of the display carton taken along line 4—4 of FIG. 3.
Figure 8:
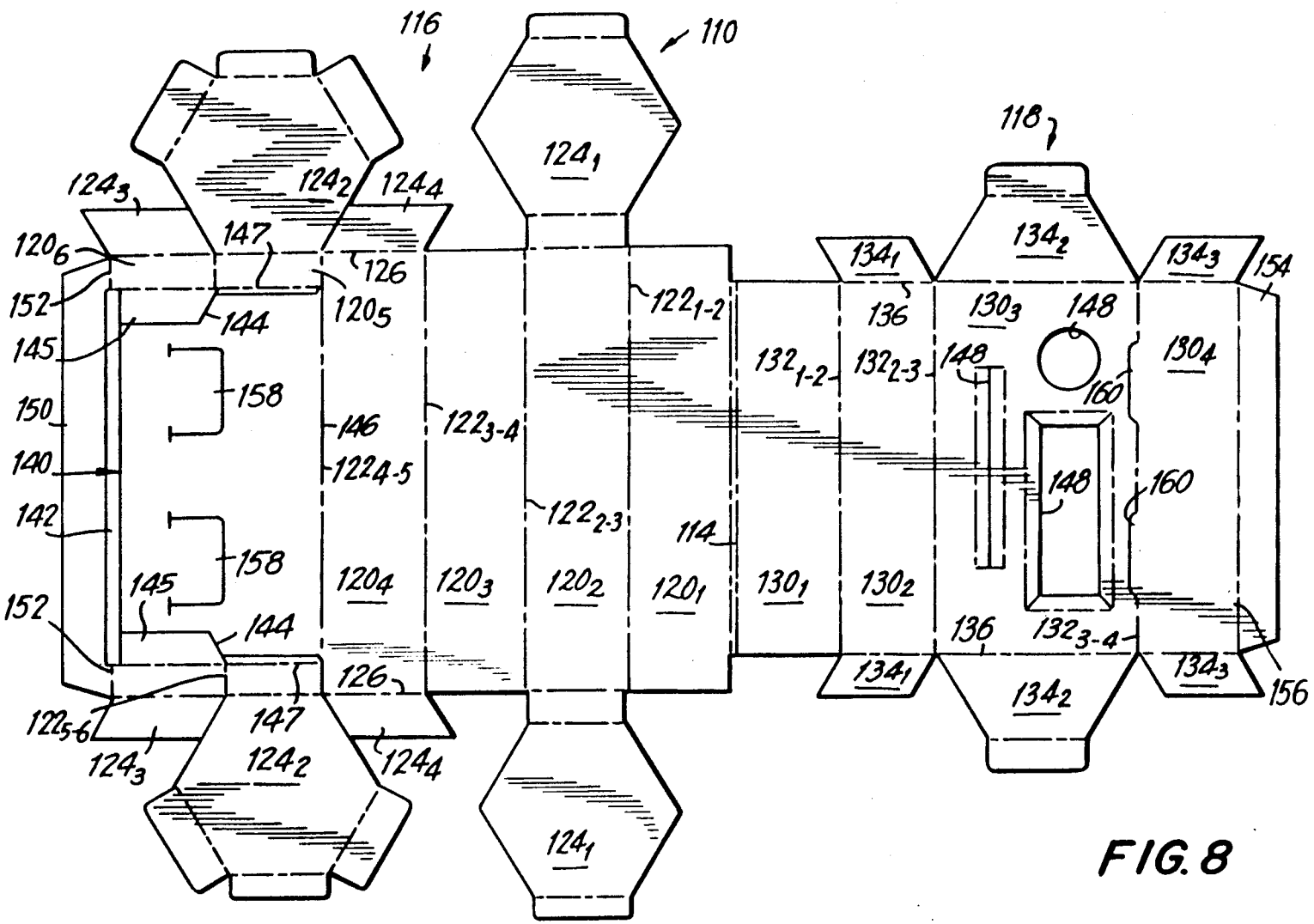
FIG. 8 is a plan view of a blank of a foldable sheet material for forming a display carton in accordance with a second embodiment of the blank of the invention.

The drawer structure 64 is then rotated relative to hinge line 14 in the direction of arrows 65 (FIG. 1(*b*)) through the opening 49 in the container structure 62 to a closed position shown in FIGS. 2–4 in which the drawer structure 64 is situated substantially within the interior of the container structure 62. The length l of the drawer structure 64 defined by the length l of each drawer panel is substantially equal to or slightly less than the corresponding dimension L (FIG. 1(*a*)) of the opening 49 into the container structure 62. Further, in the illustrated embodiment, the width w (FIG. 2) of each drawer panel is substantially equal to or slightly less than the width W of container opening 49. With the drawer structure 64 rotated to its closed position within container structure 62, the first drawer panel $30_1$ and the last container panel $20_3$ lie substantially in the same plane flush with each other so that the plane faces of the carton are formed by the container panels and one of the drawer panels.

Figure 5:
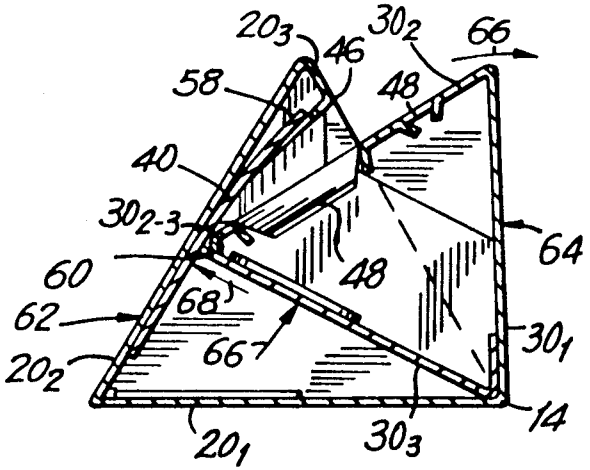
FIG. 5 is a section view similar to FIG. 3 of the display carton shown in FIGS. 2-4, and illustrating the movement of the drawer structure from a closed position towards an open position.
Figure 6:
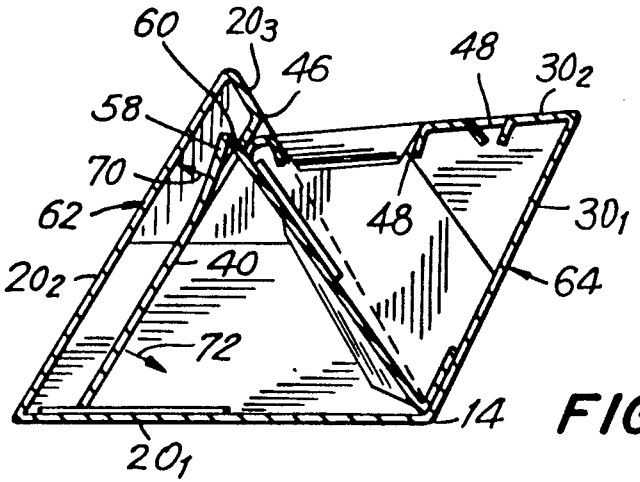
FIG. 6 is a section view similar to FIG. 5 of the display carton shown in FIGS. 2-5, and illustrating the drawer structure in an open position.

Referring now to FIGS. 5 and 6, the drawer structure 64 is rotatable between the closed position shown in FIGS. 2–4 in which it is situated substantially within the interior of the container structure 62, and an open position shown in FIG. 6 in which it is situated at least partly outside of the container structure with the drawer panel $30_2$ and any articles held therein by the cutouts 48 being visible for display. As seen in FIG. 5, as the drawer structure 64 is rotated relative to container structure 62 around hinge line 14 in the direction of arrows 66, the edge defined at the intersection of drawer panels $30_2$ and $30_3$, coinciding with the fold line $30_{2-3}$, bears against the flap 40 which in turn is urged against the inner surface of container panel $20_2$ with a force designated by arrow 68. In this manner, the flap 40 acts as a spring which imparts a desirable resisting tension or "feel" to the continued rotation of the drawer structure 64.

Figure 7:
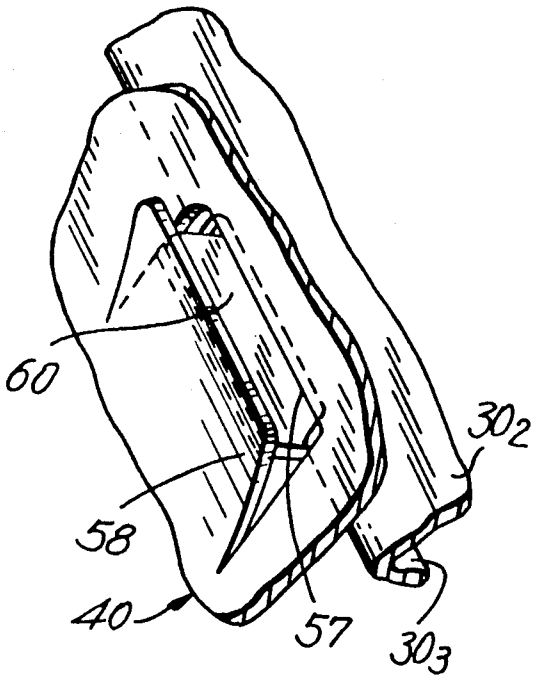
FIG. 7 is a fragmentary perspective view illustrating a part of a spring flap and cooperating detent means for locking the drawer structure in the open position.

Referring back to FIGS. 1(*a*) and 1(*b*), shaped cuts 59 are made in the drawer section 18 of blank 10 whereby a pair of detent tabs 60 are formed which extend outwardly beyond the fold line $32_{2-3}$ when the drawer structure is formed. A pair of detent flaps 58 are formed in the flap 40 in positions corresponding to the position of detent tabs 60. As the drawer structure 64 continues to rotate towards its open position, the detent tabs 60 eventually come to bear against respective detent flaps 58 bending them outwardly as best seen in FIG. 6 and 7, and engage the forward edge 57 (FIG. 7) of a detent opening created by the bending of detent flaps 58. The drawer structure 64 cannot rotate beyond the open position shown in FIG. 6 because of the engagement of the forward edges 57 of the detent openings by detent tabs 60. As such, the tabs 60 and flaps 58 constitute detent means for locking the drawer structure in the open position. The position of the detent means may be chosen so that in the open position, the intermediate drawer panel $30_2$ faces upwardly so that the articles held thereon are appropriately displayed. Moreover, the drawer structure 64 can be moved to its closed position by rotating it about the hinge line 14 in a direction opposite to that shown in FIG. 5. The tabs 60 can leave the detent openings during the closing of the draw and the spring flap 40 presents a suitable resisting tension to the closing of the drawer.

Referring now to FIGS. 8-14, second embodiments of a blank 110 and a display carton 112 in accordance with the invention are illustrated. Elements of the blank and carton shown in FIGS. 8-14 that correspond to identical or analogous components of the blank and carton shown in FIGS. 1-7 are designated by the same reference numerals, but in the "100 series. " In this embodiment, with the drawer structure 164 in its closed position, the display carton has a tubular prism-shape having a substantially hexagonal cross section.

The blank 110 is crease scored to form hinge line 114 which divides the blank into a container section 116 to the left of the hinge line 114 as seen in the drawing, and a drawer section 118 to the right of the hinge line 114. The container section 116 comprises 6 container panels $120_1$-$120_6$ of substantially equal size which are foldably interconnected to each other by crease scores defining five primary fold lines $122_{1-2}$, $122_{2-3}$. . . $122_{5-6}$ which are parallel to each other and to hinge line 114. Container end closure flaps $124_1$-$124_4$ are foldably joined to respective container panels by crease scores defining fold lines 126.

The drawer section 118 comprises four drawer panels $130_1$-$130_4$ which are foldably interconnected to each other by crease scores defining three secondary fold lines $132_{1-2}$, $132_{2-3}$ and $132_{3-4}$, each of which is parallel to the other, to hinge line 114, and to the primary fold lines of the container section. Drawer end closure flaps $134_1$-$134_3$ are foldably joined to respective drawer panels by crease scores defining fold lines 136.

A container glue flap 150 is joined to the last container panel $120_6$ by a crease score defining a fold line 152. A drawer glue flap 154 is joined to the last drawer panel $130_4$ by a crease score defining a fold line 156.

A substantially rectangular inner flap 140 comprising major parts of the last two container panels $120_5$ and $120_6$ is formed by a narrow cutout 142 extending along the glue flap fold line 152, and a pair of opposed, shaped, side-cuts 144. A hinge line 146 for flap 140 coincides with the fold line $122_{4-5}$ that interconnects intermediate panels $120_4$ and $120_5$. A pair of crease scores defining fold lines 147 interconnect the ends of the cutout 142 and the hinge line 146. When the flap 140 is bent out of the plane of the container panels $120_5$ and $120_6$ around hinge line 146, and the tabs 145 formed between the cuts 144 and fold lines 147 are folded on fold lines 147, a substantially rectangular opening 149 (FIG. 13) is formed through which the drawer structure 164 can be rotated into the interior of the container structure formed from the container section 116 of blank 110.

As in the case of the previously described embodiment, in constructing the display carton 112 from blank 110, the container structure 162 is formed by folding the container section 116 of blank 110 on primary fold lines $122_{1-2}$. . . $122_{5-6}$ and securing the glue flap 150 to the edge region of the first container panel $120_1$ with fold line 152 continguous with hinge line 114 to thereby form a prism-shaped tubular container structure 162 having a hexagonal cross section open at its ends. The end closure flaps 124 are then folded on fold lines 126 to close the ends of the container structure. The flap 140 is then bent inwardly on hinge line 146 and positioned within the interior of the container structure 162 to thereby form the opening 149 in the container structure.

The drawer structure 164 of display carton 112 is formed in a similar manner by folding the drawer section 118 of blank 110 on secondary fold lines $132_{1-2}$. . . $132_{3-4}$ and securing the glue flap 154 to the edge region of the first drawer panel $130_1$ with the fold line 156 contiguous to the hinge line 114. A prism-shaped tubular drawer structure 164 is thereby formed having a cross- section in the shape of a trapezoid, i.e. with drawer panels $130_1$ and $130_3$ substantially parallel to each other. The end closure flaps of the drawer are folded to close the ends of the drawer structure.

Figures 11, 12, 13:
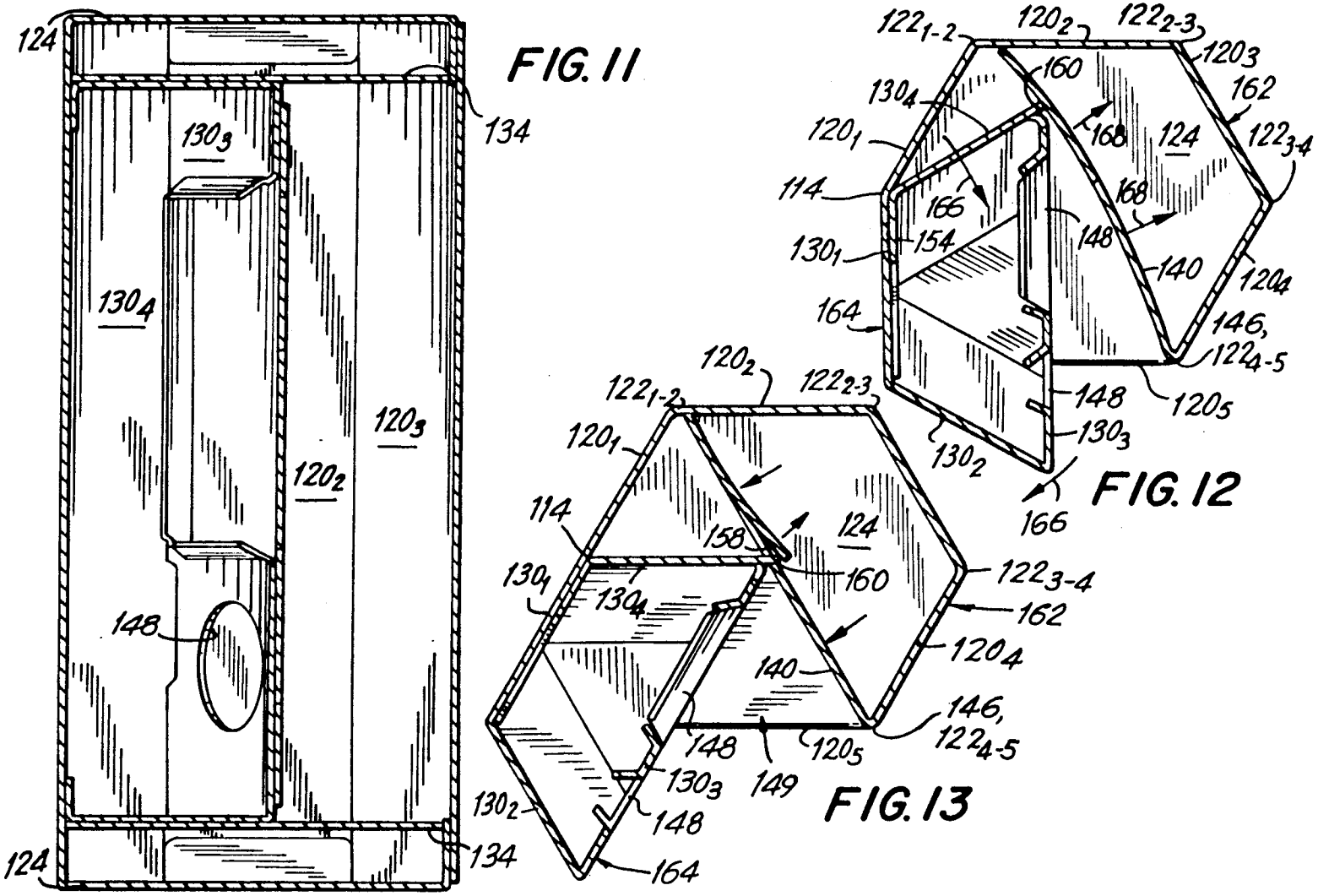
FIG. 11 is a section view of the display carton taken along line 11—11 of FIG. 10.
FIG. 12 is a section view similar to FIG. 10 of the display carton shown in FIGS. 9-11 and illustrating the movement of the drawer structure from a closed position towards an open position.
FIG. 13 is a section view similar to FIG. 12 of the display carton shown in FIGS. 9-12 and illustrating the drawer structure in an open position.

The drawer structure 164 is then rotated around the hinge line 114 into and through the opening 149 in the container structure 162 to a closed position illustrated in FIGS. 9-11 in which the drawer structure 164 is situated substantially within the interior of the container structure 162. The drawer structure 164 is shaped so that when it is in its closed position, the drawer panels $130_1$ and $130_2$ are substantially flush with the container panels $120_6$ and $120_5$ respectively as best seen in FIG. 9.

Referring now to FIGS. 12 and 13, the drawer structure 164 is rotatable between the closed position shown in FIGS. 8-11 and an open position (FIG. 13) in which it is situated partly outside of the container structure so that the drawer panel $130_3$ and any articles held therein by the cutouts and slots 148 are visible for display. As seen in FIG. 12, the drawer structure 164 is rotated outwardly relative to container structure 162 around hinge line 114 in the direction of arrows 166. As the drawer structure 164 is rotated, the edge of the drawer structure coinciding with the fold line $132_{3-4}$ bears against the flap 140 which in turn is urged against the inner surface of container panel $120_2$ with a force designated by arrow 168. In this manner, the flap 140 acts as a spring which imparts a desirable resisting tension to the continued rotation of the drawer structure 164.

As the drawer structure 164 continues to rotate towards the open position, detent tabs 160 eventually engage the forward edge 157 (FIG. 14) of the detent opening created by the bending of detent flaps 158, thereby preventing the drawer structure from further rotation.

Thus, it is seen from the foregoing that in accordance with the present invention, a display carton having a rotatable draw structure is provided which, when the drawer structure is in its closed position, comprises a polyhedron, i.e. a solid bounded entirely by plane surfaces or faces. Both of the illustrated embodiments comprise display cartons in the shape of a prism, i.e. a polyhedron having two congruent parallel faces or bases, namely the two opposed ends of the container structure, and whose remaining lateral faces are parallelograms. It will be understood that other embodiments in which the display carton is in the shape of a prism and in which the bases may be of any polygonal shape may be constructed in accordance with the invention. The display carton may be formed of a single, unitary sheet of foldable material and is space efficient and aesthetically pleasing. Any suitable foldable sheet material, such as paperboard, plastic sheet, fiberboard, combinations thereof, etc. may be used.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A display carton for holding and displaying an article, said carton being formable from a unitary blank of foldable sheet material, such as paper board, comprising:

a plurality of container panels foldably interconnected along primary fold lines to form a tubular container structure open at its ends;

container end closure flaps foldably joined to said container panels and secured in overlapped relation to close said ends of said tubular container structure;

an opening in at least one of said container panels defining an opening to the interior of said container structure;

a plurality of drawer panels foldably interconnected along secondary fold lines to form a tubular drawer structure open at its ends, one of said drawer panels being joined to one of said container panels along a hinge line;

drawer end closure flaps joined to said drawer panels and secured in overlapped relation to close said ends of said tubular drawer structure;

said drawer structure hingedly connected to said container structure with respect to said hinge line for movement through said opening between a first closed position situated substantially within the interior of said container structure and a second open position situated at least in part outside of said container structure.

2. The display carton of claim 1 wherein said primary and secondary fold lines are substantially parallel to each other and to said hinge line.

3. The display carton of claim 1 wherein said display carton is formed from a unitary blank.

4. The display carton of claim 1 wherein said display carton with said drawer structure in said first closed position forms a polyhedron having faces formed by said container panels and at least one of said drawer panels.

5. The display carton of claim 4 wherein said display carton with said drawer structure in said first closed position forms a prism having bases formed by said container end closure flaps, and faces formed by said container panels and at least one of said drawer panels.

6. The display carton of claim 5 wherein said bases of said prism are triangular in shape.

7. The display carton of claim 5 wherein said bases of said prism are equilateral triangular in shape.

8. The display carton of claim 5 wherein said container structure comprises three container panels.

9. The display carton of claim 8 wherein said opening is formed in a single one of said container panels.

10. The display carton of claim 9 wherein said display carton further comprises a spring flap formed from a section of one of said container panels, said spring flap being connected to said container structure at a hinge line substantially parallel and proximate to a primary fold line, and wherein said spring flap extends into the interior of said container structure to form said opening and is urged against said drawer structure as said drawer stucture moves between such first and second position.

11. The display carton of claim 10 further including cooperating detent means formed in said spring flap and drawer structure for preventing said drawer structure from rotating beyond said second open position.

12. The display carton of claim 8 wherein said drawer structure comprises three drawer panels.

13. The display carton of claim 12 wherein one of said drawer panels includes means formed therein for holding an article to be displayed.

14. The display carton of claim 8 wherein said drawer structure comprises a prism having triangular-shaped bases formed by said drawer closure flaps.

15. The display carton of claim 8 wherein said faces of said prism are formed by said container panels and a single one of said drawer panels.

16. The display carton of claim 5 wherein said bases of said prism are hexagonal in shape.

17. The display carton of claim 5 wherein said bases of said prism are regular in shape.

18. The display carton of claim 5 wherein said container structure comprises six container panels.

19. The display carton of claim 18 wherein said opening is formed in two of said container panels.

20. The display carton of claim 19 wherein said display carton further comprises a spring flap formed from sections of an adjacent pair of container panels, said leaf-spring flap being connected to said container structure by a hinge line substantially parallel and proximate to or at a primary fold line, and wherein said leaf-spring flap extends into the interior of said container structure to form said opening and is urged against said drawer structure as said drawer structure moves between said first and second positions.

21. The display carton of claim 20 further including cooperating detent means formed in said spring flap and drawer structure for preventing said drawer structure from rotating beyond said second open position.

22. The display carton of claim 18 wherein said drawer structure comprises four drawer panels.

23. The display carton of claim 22 wherein one of said drawer panels includes means formed therein for holding an article to be displayed.

24. The display carton of claim 18 wherein the shape of said container structure comprises a prism having hexagonal bases formed by said container end closure flaps.

25. The display carton of claim 18 wherein said faces of said prism are formed by said container panels and two adjacent ones of said drawer panels.

26. The display carton of claim 1 wherein said display carton further comprises a spring flap formed from a section of at least one of said container panels, said flap being connected to said container structure at a hinge line extending substantially parallel to and at or proximate to a primary fold line, and wherein said spring flap extends into the interior of said container structure and is urged against said drawer structure as said drawer structure moves between said first and second positions.

27. The display carton of claim 26 wherein said flap forms said opening to the interior of said container structure.

28. The display carton of claim 26 further including detent means formed in said spring flap and said drawer structure for releasably locking said drawer structure in said second open position.

29. The display carton of claim 26 further including cooperating detent means formed in said spring flap and drawer structure for releasably locking said drawer structure in said second open position, said detent means comprising at least one detent opening formed in said spring flap and at least one detent tab formed in said drawer structure, said opening adapted to lockingly receive said tab when said drawer structure is moved to said second open position.

30. The display carton of claim 1 wherein said drawer structure forms a prism having bases formed by said drawer end flaps, and faces formed by said drawer panels.

31. The display carton of claim 30 wherein one of said drawer panels includes means for holding an article to be displayed.

32. A blank of foldable sheet material, such as paperboard, for making a display carton with a hinged drawer, comprising:

a sheet having a first hinge line which divides the sheet into a container section and a drawer section;

said container section comprising at least three container panels, adjacent ones of said container panels being foldably interconnected to each other at primary fold lines, each of said primary fold lines being substantially parallel to said first hinge line, said at least three container panels including a first container panel bordered on a side by said first hinge line, a last container panel, and at least one intermediate container panel situated between said first and last container panels, and container end closure flaps foldably joined to said container panels;

said drawer section comprising at least three drawer panels, adjacent ones of said drawer panels being foldably interconnected to each other at secondary fold lines, each of said secondary fold lines being substantially parallel to said first hinge line, said at least three drawer panels including a first drawer panel bordered on a side by said first hinge line and said first container panel, a last drawer panel, and at least one intermediate drawer panel between said first and last drawer panels, and drawer end closure flaps foldably joined to said drawer panels; and wherein a flap is formed in at least said last container panel, said flap being connected to said container section at a second hinge line that extends substantially parallel to said first hinge line at or proximate to a primary fold line.

33. The blank of claim 32 wherein at least one detent opening is formed in said flap and at least one detent tab is formed on said drawer section.

34. The blank of claim 32 wherein at least one of said drawer panels includes means for holding at least one article.

35. The blank of claim 32 wherein said container section comprises three container panels and said drawer section comprises three drawer panels, said container panels being substantially of the same size.

36. The blank of claim 32 wherein said flap is formed in said last container panel.

37. The blank of claim 32 wherein said flap is formed in said last container panel and said container panel adjacent thereto.

38. A blank of foldable sheet material, such as paperboard, for making a display carton with a hinged drawer, comprising:

a sheet having a first hinge line which divides the sheet into a container section and a drawer section;

said container section comprising six container panels, adjacent ones of said container panels being foldably interconnected to each other at primary fold lines, each of said primary fold lines being substantially parallel to said first hinge line, said container panels including a first container panel bordered on a side by said first hinge line, a last container panel, and four container panels situated between said first and last container panels, and container end closure flaps foldably joined to said container panels; and said drawer section comprising four drawer panels, adjacent ones of said drawer panels being foldably interconnected to each other at secondary fold lines, each of said secondary fold lines being substantially parallel to said first hinge line, said four drawer panels including a first drawer panel bordered on a side by said first hinge line and said first container panel, a last drawer panel, and two intermediate drawer panel between said first and last drawer panels, and drawer end closure flaps foldably joined to said drawer panels.

* * * * *